United States Patent [19]

Grehan

[11] Patent Number: 4,773,176

[45] Date of Patent: Sep. 27, 1988

[54] DISPLAY OF THE BAND TYPE

[75] Inventor: Fabrice Grehan, Champs s/Marne, France

[73] Assignee: World Acrilux S.A., Ivry-sur-Seine, France

[21] Appl. No.: 6,044

[22] Filed: Jan. 22, 1987

[51] Int. Cl.[4] ..... G09F 11/18

[52] U.S. Cl. ..... 40/471; 40/387; 40/518

[58] Field of Search ..... 40/471, 387, 518, 117, 40/112; 242/54 R

[56] References Cited

U.S. PATENT DOCUMENTS

| | | | |
|---|---|---|---|
| 464,901 | 12/1891 | Sheets | 40/518 |
| 598,673 | 2/1898 | Gearhart et al. | 40/518 |
| 734,982 | 7/1903 | Smith | 40/471 |
| 1,396,553 | 11/1921 | Bovy | 40/518 |
| 1,430,509 | 9/1922 | Jones | 40/518 |
| 2,736,017 | 2/1956 | Marlowe et al. | 40/471 |
| 3,426,461 | 2/1969 | Miller | 40/471 |
| 3,510,973 | 5/1970 | Mazzocco | 40/471 |
| 3,631,618 | 1/1972 | Habuka | 40/518 |
| 3,803,582 | 4/1974 | McKee et al. | 340/324 B |
| 4,110,925 | 9/1978 | Strand | 40/471 |

FOREIGN PATENT DOCUMENTS

| | | | |
|---|---|---|---|
| 688696 | 8/1930 | France . | |
| 2269761 | 11/1975 | France . | |
| 2114355 | 8/1983 | United Kingdom | 40/518 |

*Primary Examiner*—Gene Mancene
*Assistant Examiner*—Wenceslao J. Contreras
*Attorney, Agent, or Firm*—Sughrue, Mion, Zinn, Macpeak, and Seas

[57] ABSTRACT

The display (12) comprises a band carrying a series of visual items of information and held taut between two rolls (5, 9) onto which it is rolled, the rolls being parallel to each other and rotatively mounted in a frame (1), and a synchronous driving mechanism (18) for the two rolls. The driving mechanism comprises a toothed belt or chain (21) driven by a motor (19) and cooperating with a first sprocket wheel (22) keyed on the first roll (5) and a second sprocket wheel (23) freely rotatable on the second roll (9) and connected to the latter by elastically yieldable means (25) for compensating for the tension of the band as a function of the variation in the diameter of the roll resulting from the rolling up of the band.

9 Claims, 4 Drawing Sheets

DISPLAY OF THE BAND TYPE

The present invention relates to a display comprising a band carrying a series of visual items of information and extending between two rolls on which it is rolled and driven in a synchronous manner, and to a display device comprising a plurality of band displays in particular for the automatic display of petroleum fuel prices.

Displays are known which provide only a single visual information carried by a panel which is detachably fixed in a case in which are disposed illuminating means. With such a display, the changing of the information must be carried out manually.

Displays are also known which comprise a series of L.E.D.s (light emitting diodes) which permits a number of combinations corresponding to as many visual items of information These displays are expensive.

Displays of the band type are also known which comprise a band rolled on two rolls driven by a device having a double clutch cooperating either with one or with the other of the rolls. Such a display requires the presence of moving parts and is consequently of large overall size and high cost. Further, the tension of the band is not ensured irrespective of the position of the band.

An object of the invention is therefore to provide a display of the band type comprising a band carrying a series of visual items of information and extending between two rolls on which it is rolled, the rolls being rotatively mounted in a frame to be parallel to each other and spaced apart by a distance at least equal to the length of the band occupied by a visual item of information, and a synchronous driving mechanism for the two rollers, wherein the driving mechanism comprises a toothed belt or chain driven by a motor and cooperating with a first sprocket wheel keyed on the first roll and a second sprocket wheel freely rotatively mounted on the second roll and connected to the latter by elastically yieldable means for compensating for the tension of the band as a function of the variation in the diameters of the rolls resulting from the rolling up of the band.

Advantageously, the elastically yieldable means comprise a spiral spring coaxial with the second roll.

More specifically, the invention provides a display of the band type as defined hereinbefore, and whose positioning is automatic by a remote control.

Advantageously, the band carries indications each corresponding to a visual item of information carried by the band and adapted to control the position of the band.

Advantageously, the band carries as many references as there are indications for positioning the band by comparison of the indication corresponding to the image to be displayed with the indication corresponding to the displayed image and by a counting of the references.

The invention also provides a display device comprising a series of displays of the band type according to the invention disposed in a common casing.

A better understanding of the invention will be had from the following description which is given solely by way of example with reference to the accompanying drawings in which.

Figure 1:
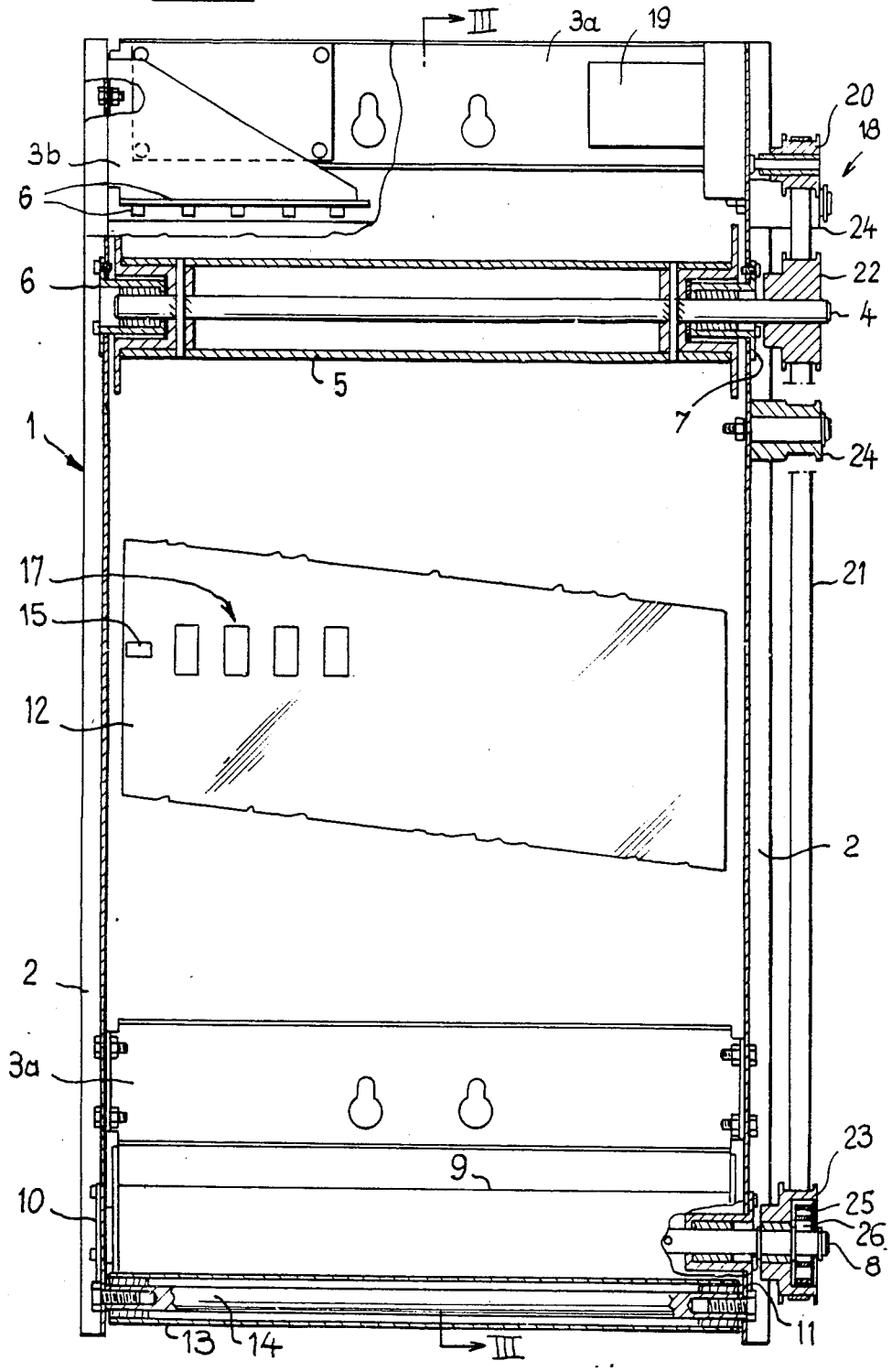
FIG. 1 is a front elevational view, partly in section, of a display of the band type according to the invention.

FIG. 1 shows a display of the band type comprising a frame consisting of first and second lateral panels 2 interconnected by two rear panels 3*a* for fixing the display on a support or in a casing (not shown) and a front panel 3*b* (partly represented).

A first shaft 4 on which is keyed a first roll 5 is rotatively mounted at one of its ends in a bearing 6 mounted on the first lateral panel 2 and, in the vicinity of its opposite end, in another bearing 7 mounted on the second lateral panel. The first roll 5 is disposed in the upper end of the frame, the shaft 4 projecting outside the second lateral panel.

A second shaft 8 on which is keyed a second roll 9 is rotatively mounted in two bearings 10, 11, in the same way as the first shaft 4 and projects out of the second lateral panel.

The second roll 9 is disposed in the vicinity of the lower end of the frame, the two rolls being parallel to each other.

Figure 3:
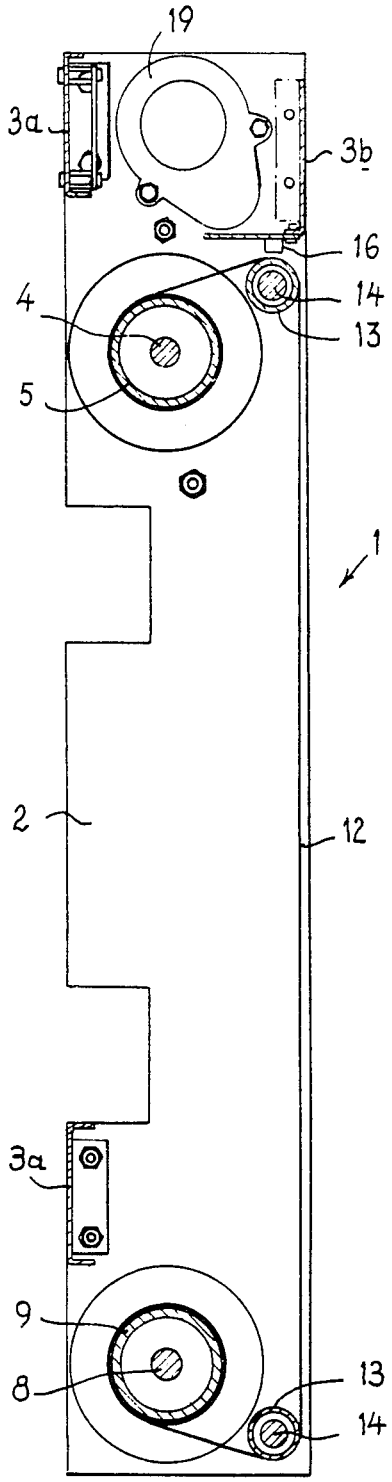
FIG. 3 is a sectional view of the display taken on line III—III of FIG. 1.

A band 12, carrying a series of visual items of information (not shown) throughout its length L, is held taut between the two rolls 5, 9 onto which it is rolled in such manner that the portion of the band located between the two rolls is located adjacent to the front side of the frame. As can be seen better in FIG. 3, the band is held taut in the vicinity of the front edges of the lateral panels 2 by two positioning rollers 13 freely rotatively mounted on shafts 14 fixed to the frame above the first roll and below the second roll, respectively.

Advantageously, illuminating means (not shown) are disposed within the frame 1 behind the band 12, the band sections carrying the items of information being transparent, translucent or fluorescent for the purpose of operation in the night.

As can be seen in FIG. 1, the band carries references or indices 15 the counting of which by means of one of the detecting means 16 adapted to be connected to a data processing circuit (not shown) and carried by a right-angled flap of the panel 3*b*, upon displacement of the band, permits the positioning of the band for a particular visual item of information to be displayed. The band also carries indications 15 for controlling the state of the band and its positioning and detected by other detecting means 16.

In this particular embodiment, these detecting means 16 may comprise infra-red ray cells disposed above the first roll, the references and indications being located on the band above each visual item of information.

The operation of the device driving the display will be described in detail with reference to FIG. 5.

Figure 2:
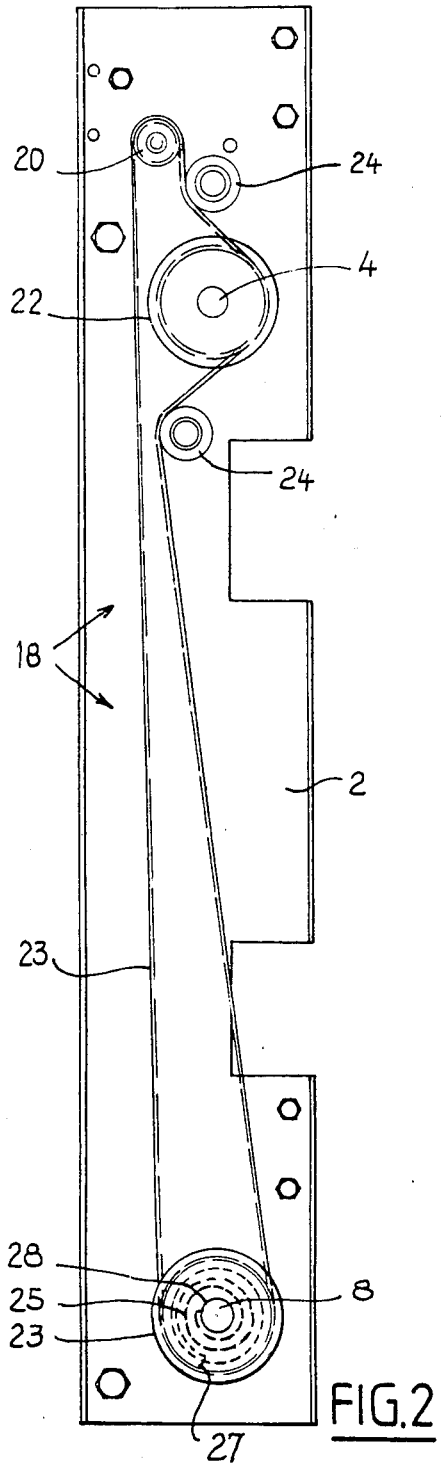
FIG. 2 is a side elevational view of the display of FIG. 1 showing the band driving mechanism in detail.

As shown in FIGS. 1 and 2, a driving mechanism 18 for the rolls comprises an electric motor 19 secured inside the frame on the second lateral panel 2.

The rotary shaft of the motor is parallel to the shafts of the rolls 5 and 9 and projects out of this lateral panel. A sprocket wheel 20 is keyed on the portion of the projecting shaft and cooperates with a toothed belt 21. This toothed belt also cooperates with a first sprocket wheel 22 keyed on the shaft 4 of the first roll, a second sprocket wheel 23 freely rotatively mounted on the shaft 8 of the second roll and two mule sprocket wheels 24 rotatively mounted on this lateral panel and located on each side of the first sprocket wheel so as to maintain a sufficient engagement of the belt on this wheel.

The second sprocket wheel 23 is connected to the shaft 8 by elastically yieldable means and, in the presently-described embodiment, by a spiral spring 25 disposed in a cavity 26 provided in the sprocket wheel. The spiral spring 25 is fixed by one of its ends to the peripheral wall 27 of the cavity 26 and by its other end in a recess 28 in the shaft 8.

This spiral spring 25 is adapted to compensate for the tension of the band 12 as a function of the variation in the diameters of the rolls driven in a synchronous manner resulting from the rolling up of the band.

Figure 4:
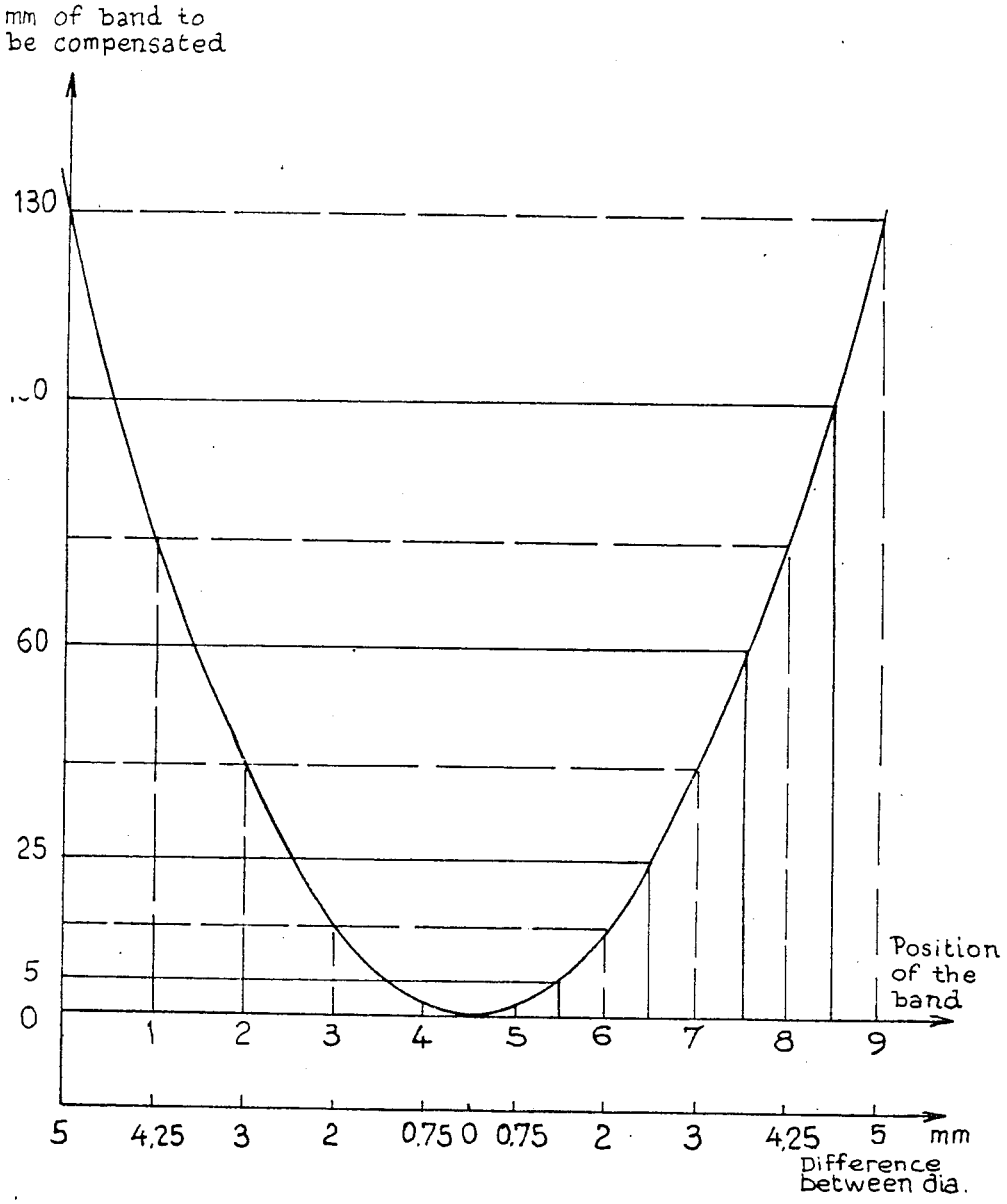
FIG. 4 is a curve representing the compensation of the tension as a function of variations in the rolling diameters for a particular display.

FIG. 4 represents a curve of variation of the length of the band to be compensated (or of the resistance opposed by the spiral spring which is proportional thereto), as a function of the position of the band or of the difference between the rolling diameters of the two rolls, these rolls having the same diameter without the band.

As can be seen in FIG. 4, the curve describes a parabola and passes through a minimum when the middle of the band is reached, the two rolls then having the same rolling diameter. The length of the band to be compensated for increases on each side of this middle point owing to the variation in the difference between the diameters of the rolls, as indicated in FIG. 4, below the position of the band represented by way of example by numbers ranging from zero to nine symbolically representing visual items of information evenly spaced apart on the band.

In order to plot this curve, there was taken by way of example a band having a length of 6 m, with a pitch of the items of information of about 50 cm. The diameter of each roll varies from 41 mm to 46 mm inversely to that of the other roll.

The spiral spring has a minimum reserve tension at the middle point. When passing from each item of information to the following, the number of rotations of the roll 5 changes progressively from 2.8 (information 0) to 3.2 (information 9); at the same time, that of the roll 9 changes from 3.2 to 2.8, the compensation between the two rolls being ensured by the action of the spiral spring which maintains in addition a substantially constant tension of the band 12.

Figure 5:
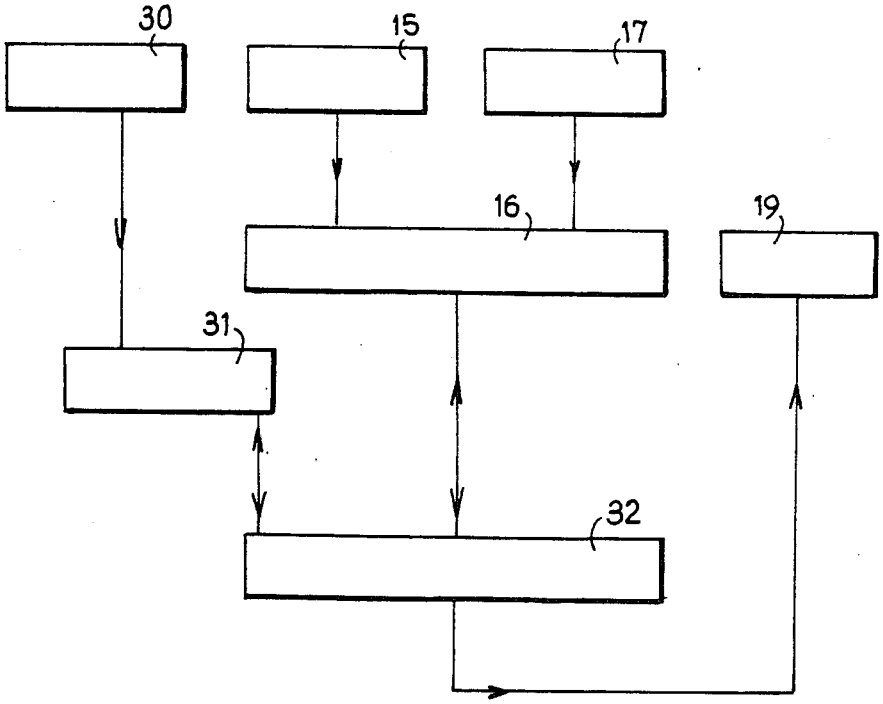
FIG. 5 is a block diagram of the device controlling the display according to the invention.

FIG. 5 is a block diagram of a control device of a display of the band type according to the invention which may be adjusted by means of coding wheels 30 adapted to be placed at a distance from the display.

The coding wheels 30 are connected to a reading and validation circuit 31 connected to a data processing circuit 32, these circuits being conventional, for example a programmable automat. The detecting means 16, for example infra-red ray cells, which detect, upon their passage, the references 15 or studs and the indications 17 of the position of the band, are also connected to the data processing circuit 32. The references and indications are located above each item of information so that they are in confronting relation to the detecting means when the corresponding image is displayed.

An output of the circuit 32 is connected to the electric motor 19 through an adaptation interface (not shown). When the reading and validation circuit is actuated, it sends to the data processing circuit the value X of the coding wheels corresponding to the item of information to be displayed. The circuit 32 then receives from the detecting means the value Y corresponding to the displayed item of information and given by the indications 17, for example in BCD code.

The circuit 32 effects the comparison of the two values and operates the motor so as to feed or advance the band through X−Y items of information by counting the references by means of the detecting means, or feeds the band rearwardly, depending on the sign of X−Y. The circuit 32 can then effect a second comparison for checking purposes.

With such displays which are cheap and have a small overall size, it is possible to construct a display panel having a series of displays and remote control the display. A particular application of these displays is the display of petroleum fuel prices whose control can be effected in parallel with that of the display of the display on the fuel pump.

What is claimed is:

1. A display device comprising a frame, a band carrying a series of visual items of information, a first roll and a second roll, onto which rolls the band is rollable and between which rolls the band is taut, the rolls being parallel to each other and rotatively mounted in said frame and spaced apart a distance which at least equals a length of the band occupied by one of said visual items of information and a mechanism for driving the two rolls and comprising a motor, a toothed belt or chain drivenly engaged with the motor and cooperating with a first sprocket wheel keyed on the first roll and a second sprocket wheel connected to the second roll with elastically yieldable means, wherein the elastically yieldable means is fixed on the one hand to the second roll and on the other hand to the second sprocket wheel.

2. The display device of claim 1 wherein the elastically yieldable means is a spiral spring.

3. The display device of claim 2, wherein the second sprocket wheel has a cavity with a peripheral surface and the elastically yieldable means is fixed on the one hand to the second roll and on the other hand to the peripheral surface of the cavity.

4. The display device of claim 1 wherein said elastically yieldable means are provided only on the second roll, the band carries indications for checking the position of the band and said indications cooperate with detecting means.

5. The display device of claim 3 wherein the second sprocket wheel is disposed outside the frame.

6. The display device of claim 1 wherein the frame comprises a lateral panel, the mechanism is disposed outside the frame on the lateral panel and the display device comprises illuminating means within the frame behind the band.

7. The display device of claim 1 wherein said second sprocket wheel is rotatably mounted on said second roll.

8. The display device of claim 9 wherein said second sprocket wheel is rotatably mounted on said second roll.

9. A display device comprising a frame, a band carrying a series of visual items of information, a first roll and a second roll, onto which rolls the band is rollable and between which rolls the band is held taut, the rolls being parallel to each other and rotatively mounted in said frame and spaced apart a distance which at least equals a length of the band occupied by one of said visual items of information and a mechanism for driving the two rolls and comprising a motor, a toothed belt or chain drivenly engaged with the motor, a first sprocket wheel keyed on the first roll, a second sprocket wheel with a cavity having a peripheral surface disposed outside the frame and the second roll and one spiral spring fixed on the one hand to the second roll and on the other hand to the peripheral surface of the cavity.

* * * * *